United States Patent [19]

Heber et al.

[11] 4,008,580

[45] Feb. 22, 1977

[54] INITIAL QUICK FREEZE PAN FOR DIRECT REFRIGERANT CONTACT COOLER

[75] Inventors: Gerald James Heber, Bellevue; Daniel Arthur George Roxburgh, Redmond, both of Wash.

[73] Assignee: Frigoscandia Contracting, Inc., Baltimore, Md.

[22] Filed: Dec. 4, 1974

[21] Appl. No.: 529,487

[52] U.S. Cl. ..... 62/376; 134/133; 206/205; 259/4 R

[51] Int. Cl.[2] ..... F25D 17/02

[58] Field of Search ..... 62/63, 64, 373, 374, 62/375, 376, 380; 220/1 R; 206/205; 134/133, 134; 259/4 R

[56] References Cited

UNITED STATES PATENTS

| | | | |
|---|---|---|---|
| 1,641,441 | 9/1927 | Kolbe | 62/63 |
| 2,760,820 | 8/1956 | Cirese | 259/4 R X |
| 3,488,973 | 1/1970 | Harben, Jr. et al. | 62/375 X |
| 3,733,839 | 5/1973 | Waldin | 62/64 |

*Primary Examiner*—Ronald C. Capossela
*Attorney, Agent, or Firm*—Dowrey & Cross

[57] ABSTRACT

The initial quick freeze (IQF) pan includes a horizontal baffle plate about which liquid freezant is recirculated continuously in a flow path having a lower reversely directed portion, a semi-circular intermediate portion, and an upper forwardly directed portion terminating at a sharp crested weir adjacent which the freezant flow divides, the relatively high velocity freezant surface layer passing over the crest of the weir while the lower main body of freezant is recirculated into the lower reversely directed flow path portion. Food particles are dropped into the freezant as it flows along the upper forwardly directed flow path portion and are carried by the relatively high velocity freezant surface layer over the crest of the weir.

19 Claims, 3 Drawing Figures

INITIAL QUICK FREEZE PAN FOR DIRECT REFRIGERANT CONTACT COOLER

BACKGROUND OF THE INVENTION

This invention relates to apparatus for extracting heat from articles, as in the freezing of foods, by directly contacting the articles with a liquid freezant, such as polyfluorinated saturated halohydrocarbon freezant, within an open topped vessel. More particularly, this invention relates to an open topped vessel hereinafter referred to as an initial quick freeze (IQF) pan in which the articles are initially contacted with liquid freezant.

Previous IQF pans, such as that disclosed in U.S. Pat. No. 3,479,833 issued to V. H. Waldin, typically include an upstream weir flow stabilizer of reverse curvature or "ski slope" configuration for inducing a current along the surface of a pool of liquid freezant therein for sweeping food particles dumped into the pool over a smooth crested downstream weir. The surface current is produced as freezant flowing off the end of the upstream weir drops into the pool. As falling freezant enters this pool, it stirs or agitates portions thereof into small eddies which entrain the remainder of the freezant within the pool and cause it to form a generally circular back-flow, the upper or surface layer of which is directed toward the downstream weir to provide or contribute to the above-described surface current.

To prevent frozen food particles from sticking to each other or to the pan surfaces, especially the bottom of the pan and the crest of the downstream weir, it is desirable to provide a uniform, high velocity surface current; however, the surface current which can be produced by backflow induced by the upstream weir in these prior IQF pans is of limited velocity. Slit openings, nozzles, jets, etc. have been proposed to supplement the effects backflow in order to increase the velocity of the surface current; however, the added surface flow produced thereby causes more freezant to be forced out of the IQF pan over the downstream weir without recirculation within the pan. Without significant freezant recirculation within the IQF pan, collection and evaporation losses of freezant once it leaves the pan, energy losses due to eddying within the freezant pool, and the additional energy required to pump in additional freezant to replace that lost over the downstream weir reduce the efficiency of the apparatus while raising its operating cost.

SUMMARY OF THE INVENTION

This invention provides an IQF pan in which these and other problems of prior art IQF pans are minimized or eliminated by increasing the surface current velocity of the freezant without increasing the volume or amount of freezant pumped through the pan. The pan is also substantially more compact than prior art pans as a result of the elimination of a compound curvature upstream weir flow stabilizer. The velocity head of incoming freezant is used to produce continuous, even backflow and recirculation of freezant within the pan. Freezant inlet flow is directed so as to entrain as much backflow as possible while simultaneously freezant already within the pan is recirculated back to the freezant inlet where it supplements backflow produced by freezant inlet flow. The only freezant flowing over the downstream weir is that necessary to carry the food particles out of and away from the pan. Thus, it will be appreciated that the IQF pan of this invention is highly effective and economical in operating because it conserves flow of freezant within the IQF pan and the freezant pumping system, and minimizes fluid energy losses due to turbulence and eddying within the pan.

According to a preferred embodiment of this invention, the IQF pan includes a generally horizontal baffle plate about which liquid freezant is circulated continuously with minimum turbulence. The baffle plate provides a generally horizontal freezant flow path including a lower reversely directed portion, an upper forwardly directed portion and a generally vertical intermediate portion in which the direction of freezant flow is turned progressively from a reverse to a forward direction. The intermediate flow path portion preferably follows a semi-circular path about the rear edge of the baffle plate. Freezant flow along the upper forwardly directed flow path portion provides a high velocity surface current for carrying food particles over a downstream weir. This weir diverts the remaining freezant flow, or lower main body of freezant flow, downwardly past the forward edge of the baffle plate back into the reversely directed flow path portion where it supplements the velocity head of incoming freezant.

Sticking of food particles to the bottom of the pan is minimized or eliminated by directing the freezant flowing through the intermediate flow path portion in an upward direction. Thus bouyant and nonbouyant food particles dropped into the forwardly directed flow path portion are swept upwardly away from the bottom of the pan and the baffle plate toward the downstream weir. The tendency of food particles to stick to the crest of the downstream weir, moreover, may be reduced by forming the downstream weir with a sharp pointed crest. This crest configuration presents less contact area to which food particles can adhere and has a lower discharge coefficient which causes freezant to flow thereover at a depth greater than that at which it flows over a round or smooth crested weir.

These and other objects, features and advantages of this invention will become apparent in the detailed description and claims to follow taken in conjunction with the accompanying drawings in which like parts bear like reference numerals.

DETAILED DESCRIPTION OF THE PREFERRED EMBODIMENT

Figure 1:
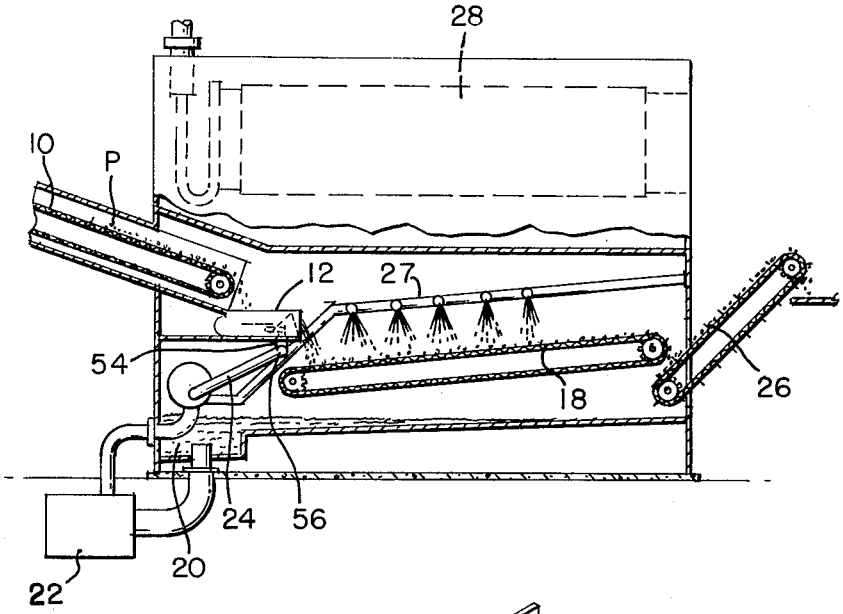
FIG. 1 is a schematic of a direct refrigerant contact cooler incorporating the IQF pan of this invention.

The initial quick freezing (IQF) pan of this invention is particularly useful with a cooler of the direct refrigerant contact type illustrated in FIG. 1. Such a cooler is used for extracting heat from articles, as in freezing of foods, in the form of bits or particles, for example, peas, beans, kernels of corn, chopped green beans, asparagus, diced carrots, etc., or entire articles such as cobs of corn, shrimp, poultry parts, meat chunks, etc. by directly contacting the articles with the liquid freezant. Coolers of this type utilize freezants which in gaseous form are heavier than air. These freezants may be held in liquid form within open topped vessels without danger of substantial amounts of freezant in its gaseous form escaping the cooler apparatus.

In the example of FIG. 1, a downwardly inclined input conveyor 10 transports the food particles P to be frozen to the initial quick freeze (IQF) pan 12 of this invention. The food particles P are dumped from the lower end of the input conveyor 10 into the IQF pan 12 in which they contact a pool of liquid freezant and become incrusted with a thin frozen shell. Most of the liquid freezant recirculates continuously within the IQF pan 12; however, the upper surface layer of the freezant pool is spilled out of the forward end of the IQF pan 12, carrying the now partially or totally frozen food particles therewith onto an intermediate mesh conveyor 18. The freezant continues to fall through the mesh conveyor 18 to the bottom of the cooler housing which is inclined downwardly from its forward to rear ends. The liquid freezant collected therein flows downwardly along the bottom of the cooler housing into a sump 20 where it is transferred by a pump 22 through an inlet pipe 24 back to the IQF pan 12. The collected food particles P are carried by the intermediate conveyor 18 to an upwardly inclined output conveyor 26. One or more spray nozzles 27 for emitting liquid freezant in spray form may be provided above the intermediate conveyor 18. The purpose of these sprays is to contact the food particles with additional freezant to produce further or complete freezing of the food particles. A condensor 28 located in the upper portion of the cooler housing condenses to liquid form freezant volatized to its gaseous form by heat extracted from the food particles. This condensed freezant also is collected in the bottom of the cooler housing and the sump 20 from which it is transferred by the pump 22 back to the IQF pan 12.

Figure 2:
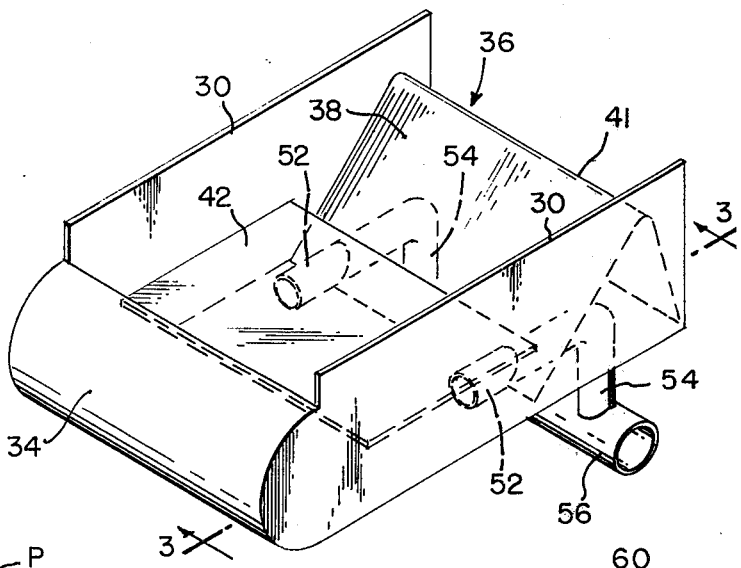
FIG. 2 is a perspective of the IQF pan of FIG. 1.
Figure 3:
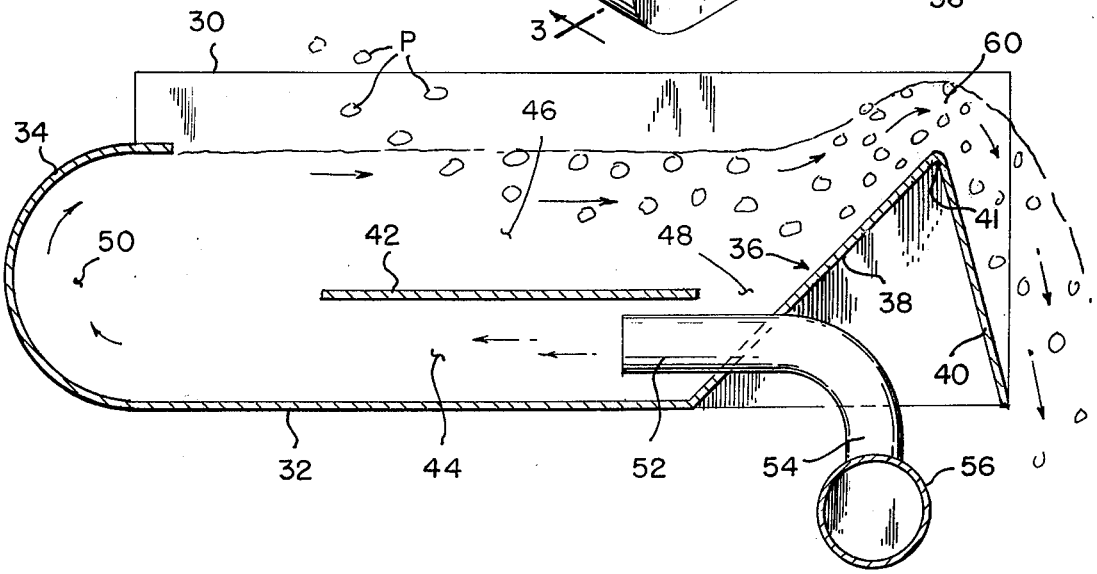
FIG. 3 is a cross section taken along lines 3—3 in FIG. 2 depicting liquid freezant flowing through the IQF pan of FIG. 1, as food particles are dumped therein.

Referring now in particular to FIGS. 2 and 3, the IQF pan of this invention comprises a generally rectangular open topped housing having vertical, mutually parallel side walls 30 and a horizontal bottom wall 32 therebetween. The pan housing terminates at its rear end in a rounded wall 34 having a generally semi-circular cross sectional configuration (see FIG. 3). The housing terminates at its forward end in a sharp pointed weir 36 of generally triangular cross sectional configuration including an upwardly inclined flat rear wall 38 and a downwardly inclined flat forward wall 40. A sharp crest 41 formed at the intersection of the forward and rear weir walls extends in a line generally transversely to the longitudinal axis or length of the pan housing. A flat generally rectangular baffle plate 42 is mounted between the housing side walls 30 substantially parallel to and spaced vertically from the face of the housing bottom wall 32 to form therebetween a lower channel 44 having a generally rectangular cross sectional configuration. The top surface of the baffle plate 42 forms an open topped upper channel 46 generally rectangular in cross section. The plane of the baffle plate 42 is slightly below the center of curvature of the housing end wall 34; however, the baffle plate may be raised or lowered to vary the vertical thickness or height of the lower and upper channels 44 and 46. The forward and rear edges of the baffle plate 42 are spaced respectively from the weir rear wall 38 and the housing rear wall 34 to form therebetween an inclined forward channel 48 and a rear channel 50 of generally semi-circular cross section interconnecting the ends of the upper and lower channels 46 and 44. The front and rear edges of the baffle plate 42 are parallel to the faces of the weir crest 41 and to the housing rear wall 34. A pair of spaced apart inlet jets or nozzles 52 project rearwardly into the lower channel 44. These nozzles are connected by pipes 54 extending through the weir rear wall 38 with a transverse manifold 56 which in turn is connected with the inlet pipe 24 and the freezant pump 22.

In the example of FIG. 3, freezant discharged from the inlet nozzles 52 is directed along a generally horizontal flow path about the baffle plate 42 to the pan outlet adjacent the weir 36. This path includes three serially arranged flow path portions: a reversely directed portion through the lower channel 44, a forwardly directed portion through the upper channel 46 superimposed and parallel to the reversely directed portion, and an intermediate portion of generally semicircular configuration through the rear channel 50. The inlet freezant discharged from the inlet nozzles 52 is first directed rearwardly to the lower channel 44 through which it flows horizontally until impinging against the housing rear wall 34. As the freezant flows upwardly along the semicircular rear channel 50, it is turned progressively through 180° and is spread transversely across the width of the pan until entering the upper channel 46 in a generally horizontal direction parallel and opposite the direction of flow through the lower channel 44. The freezant flow entering the upper channel 46 thus is of substantially uniform depth across the width of the pan.

Food particles P dumped from the lower end of the input conveyor 10 into freezant flowing within the upper channel 46 are carried thereby in a forward direction toward and over the weir 36. The upper layer or current of the freezant flow carries the food particles over the weir 36 and out the forward end of the IQF pan. At the forward terminus of the upper channel 46 adjacent the weir rear wall 38, the freezant upper current is separated or diverted by the weir 36 from the remainder of the freezant flow, passes over the weir crest 41 and down the weir forward wall 40, carrying the food particles P therewith. The lower main body of freezant flow, however, impinges against the weir rear wall 38 and is diverted thereby in a downwardly inclined direction through the forward channel 48 back to the forward end of the lower channel 44, which it re-enters by flowing about the nozzles 52.

Thus, it will be appreciated that freezant flow about the baffle plate 42 is even and continuous, with minimal turbulence in the form of eddies. Inasmuch as the freezant flow is turned smoothly as it passes between the reversely and forwardly directed portions of the flow path, the upper freezant current within the forwardly directed portion of the flow path is maintained at relatively high velocity substantially corresponding to the velocity of the incoming liquid freezant discharged from the nozzles 52. Moreover, freezant flow is conserved as the main body thereof is recirculated continuously such that the velocity head of recirculating freezant as it re-enters the lower channel 44 is used to supplement that of incoming liquid freezant discharged from the inlet nozzles 52. Sticking of the food particles P to the top side of the baffle 42 or the housing bottom wall 32 is minimized by the upward freezant flow through the rear channel 50 together with the relatively high surface velocity of freezant flow through the upper channel 46. The depth of this freezant flow, of course, may be increased by lowering the baffle plate 42 to further minimize the likelihood of heavy or nonbouyant food particles from striking and sticking to the baffle plate 42 as they are dumped into the IQF pan.

As best shown in FIG. 3, the upper layer of freezant forms a crown 60 as it flows over the weir crest 41. The weir crest 41 has a sharp pointed cross sectional configuration of low discharge coefficient which causes the freezant crown 60 to be deeper than that formed during flow over a smooth or round crested weir. This minimizes the likelihood of food particles P sticking to the weir crest 41 as they are carried thereover by the freezant flow. The illustrated weir crest also presents less surface area to which such particles can adhere.

It will be recognized that additional flow directing vanes (not shown) may be positioned adjacent or within the rear channel 50 to assist in turning of the freezant flow therethrough. Also, the disposition of the nozzles 52 may be varied so that they discharge freezant into other portions of the freezant flow path. Another advantage of the IQF pan of this invention over prior devices using upstream weirs to induce back flow is that this IQF pan is shorter in length because the upstream weir is eliminated.

While the preferred embodiment of this invention has been illustrated and described herein, it should be understood that variations will become apparent to one skilled in the art. Accordingly, the invention is not to be limited to the specific embodiment illustrated and described herein and the true scope and spirit of the invention are to be determined by reference to the appended claims.

What is claimed is:

1. In combination with a cooler for extracting heat from articles by directly contacting the articles with a liquid freezant, an initial quick freeze pan in communication with the cooler interior and having an inlet and an outlet, and means forming three serially arranged interconnected channels providing a continuously recirculating freezant flow path with entrained back flow in which articles are contacted directly with liquid freezant, the first channel communicating with said inlet for directing freezant in a reverse direction, the second channel communicting with said outlet for directing freezant in a forward direction opposite said reverse direction, the intermediate channel interconnecting adjacent ends of said first and second channels and having a configuration adapted for progressively turning freezant from said reverse direction to said forward direction, the other ends of said first and second channels communicating for direct continuous recirculation of liquid freezant from said second channel to said first channel.

2. The combination of claim 1 wherein said first and second channels are spaced apart vertically and are substantially parallel, said intermediate channel being of generally semi-circular cross sectional configuration.

3. In combination with a cooler for extracting heat from articles by directly contacting the articles with a liquid freezant, an initial quick freeze pan having an inlet and an outlet, and four serially arranged interconnected channels providing a recirculating freezant flow path in which articles are contacted directly with liquid freezant, the first channel communicating with said inlet for directing freezant in a reverse direction, the second channel communicating with said outlet for directing freezant in a forward direction opposite said reverse direction, said first and second channels being spaced apart vertically and substantially parallel, the first intermediate channel interconnecting adjacent ends of said first and second channels and having a semi-circular cross sectional configuration adapted for progressively turning freezant from said reverse direction to said forward direction, the second intermediate channel interconnecting the other ends of said first and second channels opposite said adjacent ends, and further comprising weir means for diverting the main body of the freezant directed forwardly along said second channel into said second intermediate channel such that the main body of freezant is recirculated back into said first channel.

4. The combination of claim 3 wherein said weir means comprises a member of generally triangular cross sectional configuration terminating in a sharp pointed crest which extends in a line substantially perpendicularly to the direction of freezant flow.

5. In combination with a cooler for extracting heat from articles by directly contacting the articles with a liquid freezant, means in communication with the cooler interior defining a chamber into which articles to be contacted with liquid freezant can be introduced, and having an inlet and an outlet at one end thereof, baffle plate means dividing said chamber into upper and lower channels respectively communicating with said inlet and said outlet, and interconnected at the other end of the chamber by a vertical channel, said vertical channel having a configuration adapted for progressively turning freezant exiting from the lower channel in a reverse direction so as to enter the upper channel in a forward direction, said upper and lower channels communicating adjacent the one end of said chamber for recirculation of liquid freezant from said upper channel to said lower channel.

6. The combination of claim 5 wherein said baffle plate means comprises a generally flat member terminating in a rear edge extending in a line substantially perpendicularly to the direction of freezant flow, said rear edge being so disposed that freezant flowing through said vertical channel flows therearound.

7. The combination of claim 6 wherein said vertical channel has a generally semi-circular cross sectional configuration.

8. In combination with a cooler for extracting heat from articles by directly contacting the articles with a liquid freezant, an initial quick freeze pan in communication with the cooler interior and having an inlet and an outlet, and providing a recirculating freezant flow path between said inlet and said outlet, said flow path having two superimposed portions, the upper of which terminates at said outlet such that articles dumped therein are transported by freezant flowing therein to exit said pan, weir means adjacent said outlet for diverting the surface portion of the freezant in the upper flow path portion through said outlet and recirculating the remainder of the freezant, said weir means including a member of generally triangular cross sectional configuration, said triangular member terminating in a sharp pointed crest extending substantially perpendicularly to the direction of freezant flow.

9. An initial quick freeze pan for a direct refrigerant contact cooler, comprising: an open topped housing in which articles can be contacted directly with liquid freezant, said housing providing a chamber having an inlet and an outlet at the forward end thereof, a generally horizontal baffle plate terminating in a rear edge, the disposition of said baffle plate being such that it divides said chamber into upper and lower channels respectively communicating with said outlet and inlet such that liquid freezant entering through said inlet is directed first in a reverse direction through said lower channel along the underside of said baffle plate, then progressively vertically turned about said baffle plate rear edge, and thereafter directed in a forward direction through said upper channel along the topside of said baffle plate toward said outlet, said upper and lower channels communicating adjacent the forward end of said chamber for recirculation of liquid freezant from said upper channel to said lower channel.

10. The initial quick freeze pan of claim 9, wherein said baffle plate further terminates in front edge between said inlet and outlet and spaced rearwardly therefrom, and further comprising weir means for diverting a portion of the forwardly directed freezant through said outlet and the remainder of the forwardly directed freezant in a downward direction past said front edge into said lower channel.

11. The initial quick freeze pan of claim 10, wherein said weir means comprises a member of generally triangular cross sectional configuration terminating in a sharp pointed crest which extends in a line substantially perpendicular to the direction of freezant flow.

12. The initial quick freeze pan of claim 9 wherein said housing rear end has a generally semi-circular cross-sectional configuration.

13. The initial quick freeze pan of claim 9 further comprising nozzle means directing freezant from said inlet in the reverse direction through said lower channel along the underside of said baffle plate.

14. An initial quick freeze pan for a direct refrigerant contact cooler, comprising: a housing in which articles can be contacted directly with liquid freezant, said housing including means forming three serially arranged interconnected channels providing a continuously recirculating freezant flow path with retrained back flow, the first channel communicating with an inlet, the second channel communicating with an outlet, and the intermediate channel interconnecting adjacent ends of said first and second channels, said intermediate channel being of generally semicircular cross sectional configuration, the other ends of said first and second channels communicating for direct continuous recirculation of liquid freezant from said second channel to said first channel.

15. An initial quick freeze pan for a direct refrigerant contact cooler, comprising: a housing in which articles can be contacted directly with liquid freezant, said housing including three serially arranged interconnected channels providing a recirculating freezant flow path, the first channel communicating with an inlet, the second channel communicating with an outlet disposed at one end of said housing, and the intermedite channel interconnecting adjacent ends of said first and second channels, said intermediate channel being of generally semi-circular cross sectional configuration, the other ends of said first and second channels communicating for recirculation of liquid freezant from said second channel to said first channel, and a generally horizontal baffle plate having an edge spaced from the other end of said housing adjacent the midportion of said intermediate channel, said baffle plate intervening between said first and second channels such that said second channel constitutes an upper channel, said housing further including an opening through which articles to be contacted directly with liquid freezant can be introduced into said upper channel.

16. The initial quick freeze pan of claim 15 further comprising a weir adjacent said outlet having a sharp pointed crest.

17. The initial quick freeze pan of claim 15 wherein said baffle plate further includes a second edge opposite and substantially parallel to its first-mentioned edge, said second edge being adjacent the one end of the housing and spaced therefrom to provide a second intermediate channel interconnecting the other adjacent ends of said first and second channels.

18. In combination with a direct refrigerant contact cooler, an initial quick freeze pan in communication with the cooler interior, comprising: means for directing liquid freezant in a continuously recirculating flow path with entrained back flow, said flow path including a forwardly directed portion terminating adjacent an outlet; and means adjacent said outlet or causing articles contacted directly with liquid freezant in said forwardly directed portion to be discharged through continuously the outlet along with a minor portion of liquid freezant while directly recirculating the main body of liquid freezant.

19. The combination of claim 18, wherein said means for directing liquid freezant include means for directing liquid freezant along a reversely directly portion in underlying relation to the forwardly directed portion and in a direction of flow opposite the direction of flow along said forwardly directed portion.

* * * * *